United States Patent [19]

Sulcek

[11] Patent Number: 4,478,465

[45] Date of Patent: Oct. 23, 1984

[54] COMPACTOR DOOR WITH LITERATURE STORAGE COMPARTMENT

[75] Inventor: Charles E. Sulcek, Boyle County, Ky.

[73] Assignee: Whirlpool Corporation, Benton Harbor, Mich.

[21] Appl. No.: 429,842

[22] Filed: Sep. 30, 1982

[51] Int. Cl.[3] ..... A47B 41/06

[52] U.S. Cl. ..... 312/183; 312/233; 312/320

[58] Field of Search ..... 40/124.2; 312/320, 233, 312/184, 183; 100/229 A

[56] References Cited

U.S. PATENT DOCUMENTS

| | | | |
|---|---|---|---|
| Re. 29,425 | 10/1977 | Engebretsen | 100/229 A |
| 1,038,703 | 9/1912 | Wood | 206/425 |
| 2,592,467 | 4/1952 | Reeves | 211/50 |
| 3,059,650 | 9/1962 | Nordland | 312/320 |
| 3,773,399 | 11/1973 | Sulcet | 312/204 |
| 3,845,707 | 11/1974 | Enright et al. | 100/229 A |
| 3,859,908 | 1/1975 | Karls et al. | 100/229 A |
| 4,054,088 | 10/1977 | Nee | 100/214 |
| 4,344,241 | 8/1982 | Tourre | 40/124.2 |

*Primary Examiner*—William E. Lyddane
*Assistant Examiner*—Joseph Falk
*Attorney, Agent, or Firm*—Wood, Dalton, Phillips, Mason & Rowe

[57] ABSTRACT

A refuse compacting apparatus having a hollow closure which carries a handle along its upper edge is provided with literature storage means within the closure. The handle is provided with downwardly opening slot through which the literature is inserted to be held in a pocket formed within the closure at a suitable position below the slot. The spacing of the bottom of the pocket below the slot is preselected to permit the upper portion of the literature to project outwardly from the slot for facilitated viewability and accessibility. The pocket structure further serves to resiliently bias the closure panels so as to reduce rattling or vibration. The pocket-forming structure cooperates with a boss on the rear panel of the closure in guiding the literature into the desired inserted disposition within the pocket. The handle further defines a protective cover overlying the slot providing spill protection for the literature stored in the pocket.

17 Claims, 4 Drawing Figures

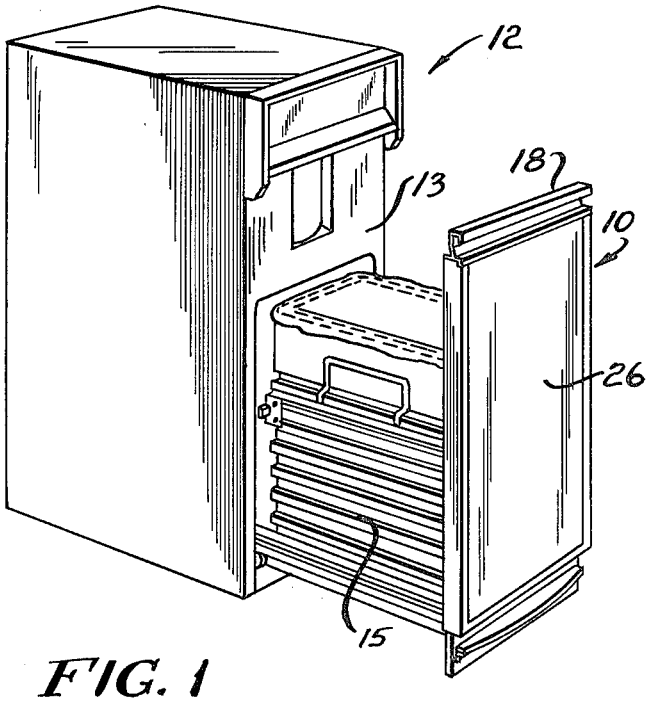
FIG. 1
FIG. 3
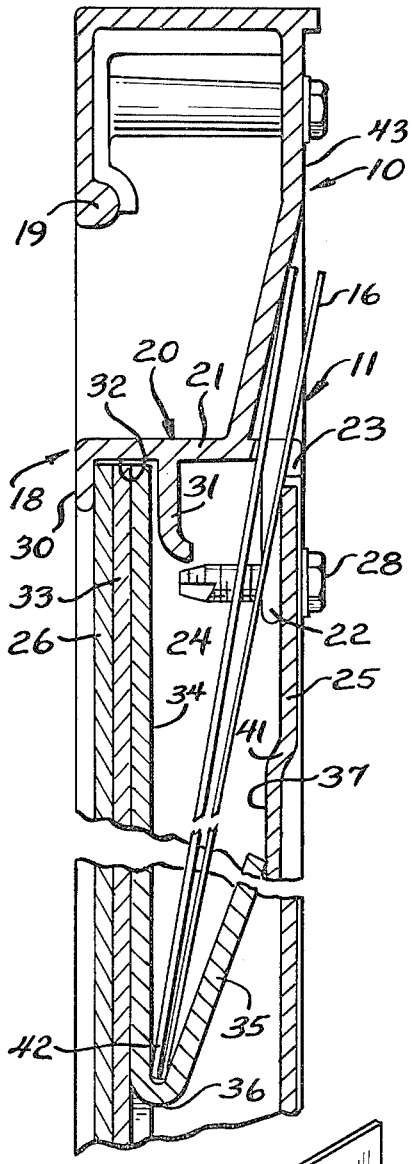
FIG. 2
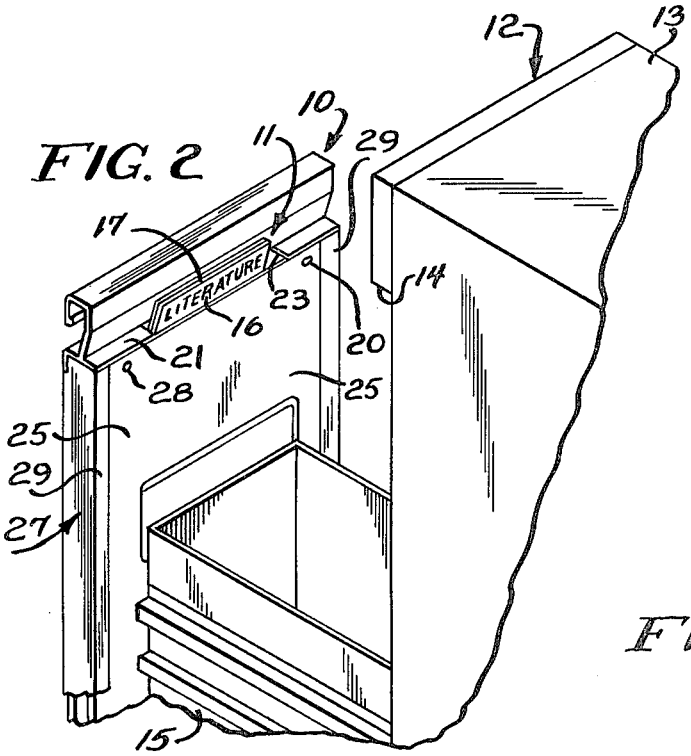
FIG. 4
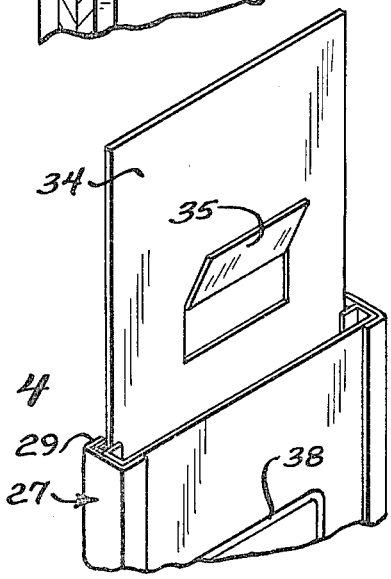

COMPACTOR DOOR WITH LITERATURE STORAGE COMPARTMENT

BACKGROUND OF THE INVENTION

1. Field of the Invention

This invention relates to door structures, and in particular to a door structure for a domestic refuse compactor which is provided with means for carrying sheet material, such as literature and the like.

2. Description of the Background Art

In U.S. Pat. No. 3,773,399 of Charles E. Sulcek, which patent is owned by the assignee hereof, a refuse compactor is disclosed having a drawer-like compacting receptacle provided with a drawer front wherein the front panel may be readily replaced by slidable mounting thereof in side channels. The drawer front includes a front panel and a rear panel and a frame including an upper handle portion for opening the drawer.

Herbert M. Reeves discloses, in U.S. Pat. No. 2,592,437, a recipe card holder for stoves. A plurality of recipe card holders are provided, each of which is adapted to hold a number of recipe cards. The stove drawer is constructed to removably support the holders in a covered disposition. The holders are detachably supported from a ledge provided on the door by means of a hook on the top of the holder.

In U.S. Pat. No. 3,845,707, James H. Enright et al disclose a trash compactor wherein an access door is provided with a hollow interior, or pocket, and a dispensing slot in the rear panel of the door through which folded bags are inserted and withdrawn for use in lining the compactor basket.

Another form of trash compactor having means on the door for storing bags is shown in U.S. Pat. No. 4,054,088 of Michael A. Nee. As shown therein, an upwardly opening container is provided on the rear of the door to serve for trash bag storage and a deodorizer.

SUMMARY OF THE INVENTION

The present invention comprehends a closure construction for a refuse compactor, wherein the closure is provided with improved means for storing literature sheets and the like therein.

In particular, the invention comprehends a door or drawer front structure having an upper handle defining a slot for insertion and withdrawal of literature sheets and the like relative to a storage pocket provided within the structure subjacent the slot.

The handle further defines a protective cover overlying the slot to prevent spillage of refuse and the like into the pocket as during loading of refuse in the compactor.

A plurality of interchangeable front panels are stored within the door or drawer front. The means defining the pocket further serves as means for biasing the panels forwardly.

The rear panel of the structure includes a forwardly extending boss which cooperates with the wall means defining the bottom of the pocket for directing literature sheets and the like into fully inserted disposition in the pocket.

The entrance to the storage pocket is located to effectively preclude passage of refuse and the like thereinto, while, at the same time, permits the literature sheets to extend a short distance outwardly through the slot for facilitated visibility and accessibility.

More specifically, the invention comprehends the provision in a door or drawer front having a handle extending across the upper edge thereof of an improved literature storage means including means defining an upwardly open space, means on the handle defining a slot opening downwardly into the space, and means defining a bottom support spaced below the slot for supporting sheet material inserted downwardly into the space through the slot, the support being positioned to cause a top portion of the inserted sheet material to be exposed at the slot for grasping by a user to permit selective removal of the sheet material from the space as desired.

In the illustrated embodiment, a portion of the handle overlies the slot to protect the pocket from intrusion of refuse, spillage, and the like.

In the illustrated embodiment, the slot effectively opens at an angle to the vertical, permitting the sheet material to be disposed angularly in the stored disposition.

In the illustrated embodiment, wall means defining the pocket further defines biasing means for resiliently biasing the additional interchangeable panels against the front panel of the door or drawer. The wall means comprises a sheet provided with a rearwardly folded flap defining the bottom of the pocket and resiliently bearing against the rear panel.

In the illustrated embodiment, the rear panel defines an inwardly projecting boss and the wall means flap engages the boss.

The literature storage means of the present invention is extremely simple and economical of construction while yet providing the highly desirable features discussed above.

BRIEF DESCRIPTION OF THE DRAWINGS

Other features and advantages of the invention will be apparent from the following description taken in connection with the accompanying drawings wherein:

FIG. 1 is a perspective view of a refuse compactor having literature storage means embodying the invention;

FIG. 2 is a fragmentary perspective view of the compactor looking forwardly from the rear thereof and with the compactor drawer in an open, access position illustrating the disposition of the literature sheet material in the storage pocket thereof;

FIG. 3 is a fragmentary enlarged vertical section illustrating in greater detail the literature storage means; and FIG. 4 is a fragmentary perspective view illustrating the insertion of the wall means defining the bottom of the literature storage pocket into the hollow door construction.

DESCRIPTION OF THE PREFERRED EMBODIMENT

In the illustrative embodiment of the invention as disclosed in the drawing, a closure which may comprise a drawer front or door, 10 (hereinafter referred to as a door) is provided with new improved sheet literature material storage means generally designated 11. Door 10 is associated with a refuse compactor generally designated 12, having a housing 13 defining a front access opening 14, which is selectively closed by the door 10. As seen in FIG. 2, the door is mounted on the front of a drawer 15 defining a refuse-receiving receptacle in which the refuse is compacted by suitable compacting means (not shown) within housing 13. The drawer is movable to a forwardly access position, as seen in FIG. 2, wherein the rear of the door is exposed. As shown, the literature storage means 11 is arranged to store the sheet literature 16 in an upper rear portion of the door so that the upper end portion 17 of the literature projects slightly outwardly therefrom for facilitated removal and viewability.

Door 10 effectively comprises a hollow door having the top portion thereof closed by a handle 18 for moving the drawer between the compacting and access positions relative to the housing 13.

The handle includes a grasping portion 19 and a lower mounting portion 20 including a generally horizontally extending base portion 21 and a downwardly extending rear flange 22. The base and flange are cut away to define a slot 23 which opens downwardly and forwardly at an angle into a space 24 defined within the door between a rear panel 25 and a front panel 26 thereof. The rear and front panels are effectively retained in a surrounding frame generally designated 27 which includes, as a portion thereof, the lower portion 20 of handle 18. More specifically, rear panel 25 is secured to the flange 22 of the handle lower portion 20 by suitable screws 28 at opposite sides of slot 23.

As best seen in FIG. 4, the frame 27 includes side channels 29 embracing the side edges of rear panel 25 and the front panel 26.

As shown in FIG. 3, handle bottom portion 20 further defines a pair of spaced, downturned front flanges 30 and 31 defining therebetween a channel 32 for receiving the upper ends of the front panel 26 and one or more additional panels 33 which may be selectively substituted for front panel 26, as desired.

A panel spacer 34 is provided at the rear of the panels 33 with its upper edge also received in channel 32 forwardly of flange 31, as shown in FIG. 3. As illustrated in FIG. 4, spacer panel 34 is formed with an integral folded flap 35 which is turned about a fold line 36 to extend rearwardly upwardly into engagement with the front surface 37 of the rear panel 25. Rear panel 25 is provided with a forwardly projecting rectangular boss 38 and, as seen in FIG. 3, flap 35 engages the boss. As shown in FIG. 4, panel 34 is slid downwardly into the front channel 39 of the side frame members rearwardly of the front panel 26 and additional one or more panels 33 prior to the installation of the handle 18 on the top of the door.

As illustrated in FIG. 3, the folded portion 35 of the spacer panel effectively defines a pocket 40 in door space 24 for receiving the lower end of the literature sheet material 16. The inclined upper edge portion 41 of the boss 38 and the inclined disposition of flap 35 serve as means for guiding the lower end 42 of the literature sheet material into the bottom of pocket 40 adjacent the fold 36. As further illustrated in FIG. 3, the bottom of the literature storage pocket 40 is spaced forwardly of slot 23 so as to define an inclined storage position for the sheet material 16 and permit the material to be inserted into the storage means 11 without bending or distortion.

In the illustrated embodiment, the spacer panel 34 may be formed of a resilient material, such as suitable plastic or paperboard, whereby the folded flap 35 resiliently biases panel 34 forwardly away from rear panel 25 and toward front panel 26, thereby urging the intermediate panels 33 forwardly against the front panel 26. This arrangement provides improved, vibration free retention of the panels in the door while providing a positive means for retaining the pocket 40 open to receive literature or the like.

An upstanding portion 43 of handle 18 extends rearwardly to overlie slot 23, as seen in FIGS. 2 and 3, so as to effectively prevent intrusion of refuse and the like into the pocket 40 as during placement of the refuse in the drawer 15 in the normal loading operation of the refuse compactor. Splashing and throwing of items of the refuse may occur during the forceful compaction operation, but the location of slot 23 in the uppermost portion of the door and the overlying protective relationship of the handle portion 43 to the slot 23 effectively prevent such splash and thrown material from entering the slot.

By providing the flap 35 in the spacer panel 34 and the slot 23 in the door handle 18, an improved literature storage means is provided in the door at minimum expense and modification of the standard door construction.

In use, the operating instructions, wiring diagrams, etc., provided with the refuse compactor, may be retained in the storage pocket 40 for facilitated withdrawal and use by the user or serviceman. By maintaining such literature in association with the apparatus itself, loss thereof is effectively avoided. Suitable instructions may be included in the literature 16 for use by the operator of the apparatus in avoiding the necessity of service calls. As best seen in FIG. 2, the projecting upper portion 17 of the literature is readily viewable by the user so that the user is aware of the disposition of the literature in the door pocket, and as discussed above, the projecting upper end portion facilitates removal of the literature from the pocket, when desired.

While the invention is disclosed in a door associated with a refuse compactor for which the novel literature storage means is advantageously adapted, the invention comprehends the provision of such improved literature storage means in appliances generally where it is desirable to retain servicing and other information in readily accessible and viewable disposition in the appliance door.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compacting apparatus having a generally vertical closure for providing access to a refuse receptacle, said closure defining a bottom and an upper portion and having a handle fixed to and extending horizontally across said upper portion thereof, the improvement comprising:

means on said handle defining a slot opening downwardly into a generally vertical internal space defined by said closure; and means in said door defining a raised pocket means spaced below said slot and above said closure bottom for removably supporting sheet material inserted downwardly into said space through said slot, said pocket defining a bottom support for the material in said pocket means positioned to cause a top portion of the inserted sheet material to be disposed to be accessible at said slot for grasping of the sheet material by a user to permit selective removal of the sheet material from the pocket means as desired.

2. The refuse compacting apparatus of claim 1 wherein a portion of said handle extends upwardly from and overlies said slot.

3. The refuse compacting apparatus of claim 1 wherein said slot effectively opens at an angle to the vertical, permitting the sheet material to be disposed at an angle to the vertical in said pocket means.

4. The refuse compacting apparatus of claim 1 wherein a portion of said handle overlies said slot to define a guide for the sheet material and a protective cover for the top portion of the sheet material at said slot.

5. In a refuse compacting apparatus having a housing defining an access opening, and a closure defined by a pair of facially spaced vertical panels, said closure being movably mounted to said housing for providing selective access into said housing through said opening, improved means for providing a sheet material storage compartment in said closure comprising:

a handle extending along an upper edge of said closure, said handle including a generally horizontal base portion overlying the space between said spaced panels;

means defining a slot through said handle base portion opening downwardly into said space; and means within said space defining a riased storage pocket means for removably holding sheet material and the like inserted into said pocket through said slot, said pocket means defining a bottom support for the material in said pocket means positioned to cause a top portion of the inserted sheet material to be disposed to be accessible at said slot for grasping of the sheet material by a user to permit selective removal of the sheet material from the pocket means as desired.

6. The refuse compacting apparatus of claim 5 wherein said handle includes a portion which extends upwardly at an angle so as to overlie said slot and thereby define means for preventing spillage of refuse being inserted into said apparatus from entering into said storage pocket means.

7. The refuse compacting apparatus of claim 5 wherein said handle includes upwardly extending guide means for guiding the sheet material angularly downwardly through said slot into said storage pocket means.

8. The refuse compacting apparatus of claim 5 wherein said means defining said storage pocket means further comprises biasing means for resiliently biasing said spaced vertical panels.

9. The refuse compacting apparatus of claim 5 wherein said means defining said storage pocket means comprises a vertically disposed sheet member, said sheet member extending generally parallel to said spaced panels and including an integral flap which extends upwardly towards said slot.

10. In a refuse compacting apparatus closure having a peripheral frame, a front panel movably retained in said frame, and a rear outer panel carried by the frame to define a space therebetween, the improvement comprising means defining a storage pocket means in said space for holding sheet material removably therein, said storage pocket means further defining resilient biasing means acting between said front and rear panels to retain said front panel against rattling in said frame.

11. The refuse compacting apparatus of claim 10 wherein said frame includes a handle portion for manipulating the closure, and said pocket means opens outwardly through said handle.

12. The refuse compacting apparatus of claim 10 wherein said means defining said storage pocket means comprises a sheet member provided with a rearwardly folded flap defining the bottom of said pocket.

13. The refuse compacting apparatus of claim 10 wherein said means defining said storage pocket means comprises a sheet member provided with a rearwardly folded flap defining the bottom of said pocket means and resiliently bearing aga:nst the rear panel.

14. The refuse compacting apparatus of claim 10 wherein said rear panel defines a boss projecting into said space and said means defining said storage pocket means comprises a sheet member provided with a rearwardly folded flap which bears against said boss and defines the bottom of said pocket means.

15. The refuse compacting apparatus of claim 10 wherein at least one additional front panel member is carried by said frame and disposed within said space, and wherein said resilient biasing means acts to bias said additional panel towards said front panel.

16. In a refuse compacting apparatus having a housing defining an access opening, and a closure for said opening having a peripheral frame and front and rear spaced vertical panels carried by said frame, said frame defining a bottom and an upper portion, means for storing sheets of literature or the like in the space between said panels, comprising:

a handle extending along an upper edge of said upper portion of the closure, said handle including a horizontal base portion overlying said space between said panels and an upstanding portion which extends upwardly and rearwardly from said base portion;

means defining a slot through said handle base portion opening downwardly into said space, said slot being positioned rearwardly of said upstanding handle portion such that said upstanding handle portion overlies said slot;

means defining a boss on said rear closure panel, said boss extending partially into the space between said panels; and a panel spacer formed of resilient material and carried by said frame, said panel spacer being disposed within the space between said front and rear panels and having an integral flap extending rearwardly and upwardly into contact with said boss so as to define with said rear panel a storage pocket means spaced above said closure bottom for receiving sheet literature inserted through said slot.

17. The refuse compacting apparatus of claim 16 wherein said upstanding handle portion forms a guide means which defines a literature insertion path which is inclined forwardly downwardly from the vertical and wherein said panel spacer is disposed within said space substantially forwardly of said slot, whereby said flap and said slot cooperate to define an inclined literature storage pocket which extends generally along said inclined literature insertion path.

* * * * *